US005180295A

United States Patent [19]

Swain et al.

[11] Patent Number: 5,180,295

[45] Date of Patent: Jan. 19, 1993

[54] SCROLL COMPRESSOR OLDHAM COUPLING HAVING ANTI-FRICTION MEANS

[75] Inventors: James C. Swain, Columbus; John P. Wilcox, Delaware, both of Ohio

[73] Assignee: General Motors Corporation, Detroit, Mich.

[21] Appl. No.: 825,352

[22] Filed: Jan. 24, 1992

[51] Int. Cl.[5] ..... F04C 18/04; F16D 3/04

[52] U.S. Cl. ..... 418/55.3; 464/102

[58] Field of Search ..... 418/55.3; 464/102, 103

[56] References Cited

U.S. PATENT DOCUMENTS

| | | | |
|---|---|---|---|
| 4,259,043 | 3/1981 | Hidden et al. | 418/55.3 |
| 4,551,078 | 11/1985 | Hiraga | 418/57 |
| 4,911,620 | 3/1990 | Richardson, Jr. et al. | 418/181 |

FOREIGN PATENT DOCUMENTS

| | | | |
|---|---|---|---|
| 54-161445 | 11/1979 | Japan | 464/103 |
| 55-87884 | 7/1980 | Japan | 418/55.3 |
| 58-170880 | 10/1983 | Japan | 418/55.3 |
| 62-147072 | 7/1987 | Japan | 418/55.3 |
| 2-176177 | 7/1990 | Japan | 418/55.3 |
| 2-264173 | 10/1990 | Japan | 418/55.3 |

*Primary Examiner*—John J. Vrablik

*Attorney, Agent, or Firm*—Ronald L. Phillips

[57] ABSTRACT

A scroll compressor 10 includes a housing 12, a fixed scroll 26, an orbital scroll 48, a scroll drive assembly 74 and an axial thrust and anti-rotation assembly 108. The axial thrust and anti-rotation assembly includes a pair of scroll key ways 110 and 112, a pair of housing key ways 122 and 124 and an Oldham coupler 132 with key blocks 140 and 142 positioned in the scroll key ways and a pair of key blocks 148 and 150 positioned in the housing key ways. Axial loads exerted on the orbital scroll and end plate 50 by fluid under pressure are transferred from the end plate 50 to roller bearings 118 and 120 mounted in the scroll key ways 110 and 112, to the key blocks 140 and 142, to the ring 134 to thrust roller assemblies 156 and 158 in contact with a surface 136 of the Oldham coupler ring 134 and to the housing 12.

3 Claims, 4 Drawing Sheets

SCROLL COMPRESSOR OLDHAM COUPLING HAVING ANTI-FRICTION MEANS

TECHNICAL FIELD

The invention relates to a fluid displacement apparatus and more particularly to a scroll type compressor with one fixed scroll, one orbital scroll and an Oldham Coupling to prevent rotation of the orbital scroll.

BACKGROUND OF THE INVENTION

Scroll type compressors with one fixed scroll and one orbital scroll are used to compress refrigerant in mobile air conditioning systems. These compressors include a housing with a fluid inlet and a fluid outlet. A fixed scroll and an orbital scroll are positioned inside the housing. A drive assembly is provided to drive the orbital scroll in an orbital path. An axial thrust and anti-rotation assembly is mounted in the housing to limit the orbital scroll to orbital movement and to maintain the scrolls in proper relationship relative to each other.

The fixed scroll has an end plate, an involute wrap and a central discharge aperture. The orbital scroll has an end plate and an involute wrap. The fixed scroll is secured in the housing and the orbital scroll cooperates with the fixed scroll to form at least one pair of sealed fluid pockets.

The orbital scroll drive includes a crankshaft rotatably journaled in the housing. A crank pin portion of the crankshaft is connected to the orbital scroll to orbit the scroll in an orbital path. When the orbital scroll is driven in an orbital path, the sealed fluid pockets formed by the scroll wraps and end plates move toward the center of the scrolls, become smaller and compress the fluid they contain. The compressed fluid leaves the scrolls through the discharge aperture in the fixed scroll end plate and is discharged from the compressor housing through the fluid outlet.

The axial thrust and anti-rotation assembly axially positions the orbital scroll relative to the fixed scroll to keep the fluid pockets sealed and in conjunction with the axial tip seals, allow axial expansion of the scroll wraps that results from increased temperatures during operation. The axial thrust and anti-rotation assembly also prevents rotation of the orbital scroll while allowing generally circular orbital motion.

One common axial thrust and anti-rotation system includes a plurality of axial thrust balls positioned between a ball race on the front wall of the orbital scroll and a ball race mounted in the front section of the housing. A pair of rings with circular ball apertures are positioned between the ball races with the axial thrust balls in the circular ball apertures. One ring is attached to the housing and the other ring is attached to the orbital scroll. The circular ball apertures in both rings have a diameter, which allows the axial thrust balls to move in a circular orbit when the orbital scroll is driven in a circular orbit and which prevents rotation of the orbital scroll. Axial thrust and anti-rotation systems with axial thrust balls have a large number of parts, are somewhat difficult to assemble and require close manufacturing tolerances. They also require substantial axial space thereby increasing the length of the compressor. The point contact between the balls and flat surfaces of the ball races, may result in rapid wear if the parts are not properly hardened.

Oldham couplers are used to prevent rotation of orbital scrolls in relatively large stationary systems. These couplers are used in combination with complicated axial thrust structures for axially fixing the orbital scroll or the couplers include large heavy rings that require substantial space and are difficult to balance. Balancing is very important in vehicle applications where the compressor must be able to operate over a relatively large speed range.

SUMMARY OF THE INVENTION

The primary object of this invention is to provide a scroll compressor with an Oldham coupler to prevent rotation of an orbital scroll.

Another object of this invention is to provide an Oldham coupler which allows reduced axial space within a compressor housing.

A further object is to provide a lightweight Oldham coupler in a scroll compressor.

A still further object of the invention is to provide a scroll compressor with an Oldham coupler which prevents axial separation of the two scrolls.

The scroll compressor of this invention includes a housing, a fixed scroll mounted in the housing, an orbital scroll cooperating with the fixed scroll, an orbital scroll drive and an axial thrust and anti-rotation assembly. The axial thrust and anti-rotation assembly includes a pair of scroll key ways in the front surface of the orbital scroll end plate, and a pair of housing key ways in the front section of the housing. Anti-friction members are mounted in each orbital scroll key way. An Oldham coupler, including a ring with a front surface and a rear surface, has a first pair of key members extending from the rear surface of the ring. A second pair of key members extend from the front surface of the ring. The first pair of key members are positioned in the orbital scroll key ways. The second pair of key members are positioned in the housing key ways. Anti-friction members are also mounted in the front section of the housing and contact the front side of the Oldham coupler ring adjacent to the first pair of key members extending from the rear surface of the ring.

Transferring axial loads from the orbital scroll to the housing with the structure set forth above reduces the in-plane bending and the twisting loads on the Oldham coupler ring in a plane perpendicular to the axis of rotation of the scroll drive crankshaft. The reduced load allows the use of a thin light weight ring in the Oldham coupler, reduced axial length for the compressor and decreased vibration due to oscillation of the Oldham coupler.

The foregoing and other objects, features and advantages of the present invention will become apparent in the light of the following detailed description o exemplary embodiments thereof, as illustrated in the accompanying drawing.

Figure 1:
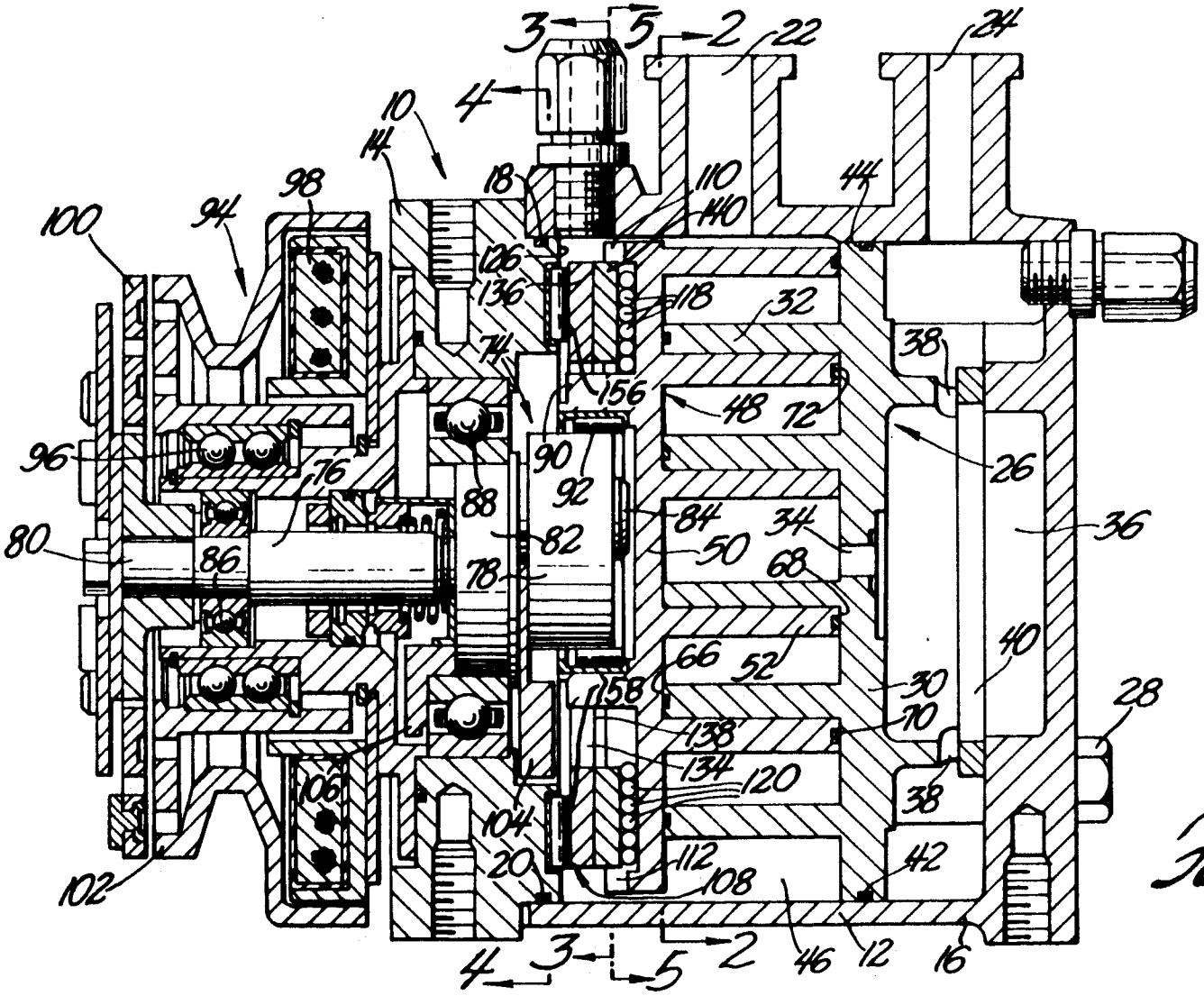
FIG. 1 is a vertical sectional view of a scroll compressor with the axial thrust and anti-rotation assembly of this invention.

The scroll type compressor 10, as shown in FIG. 1 includes a housing 12 with a front section 14 and a rear section 16. The two sections are held together by bolts that are not shown. A seal 18 is provided in a groove 20 in the front section 14 of the housing 12 to seal the housing at the joint between the front section and rear section. A fluid inlet passage 22 is provided in the housing 12. A fluid outlet passage 24 is also provided in the housing 12.

A fixed scroll 26 is secured in the rear section 16 of the housing 12 by bolts 28. The fixed scroll 26 includes an end plate 30 and an involute spiral wrap 32. A discharge aperture 34 is provided in the center portion of the fixed scroll end plate 30 for the passage of compressed fluid into a discharge chamber 36, through passages 38 and through the fluid outlet passage 24. A gauge ring 40 axially positions the fixed scroll 26 in the housing 12. A seal 42 in a groove 44 in the end plate 30 of the fixed scroll 26 seals the discharge chamber 36 from an inlet chamber 46.

Figure 2:
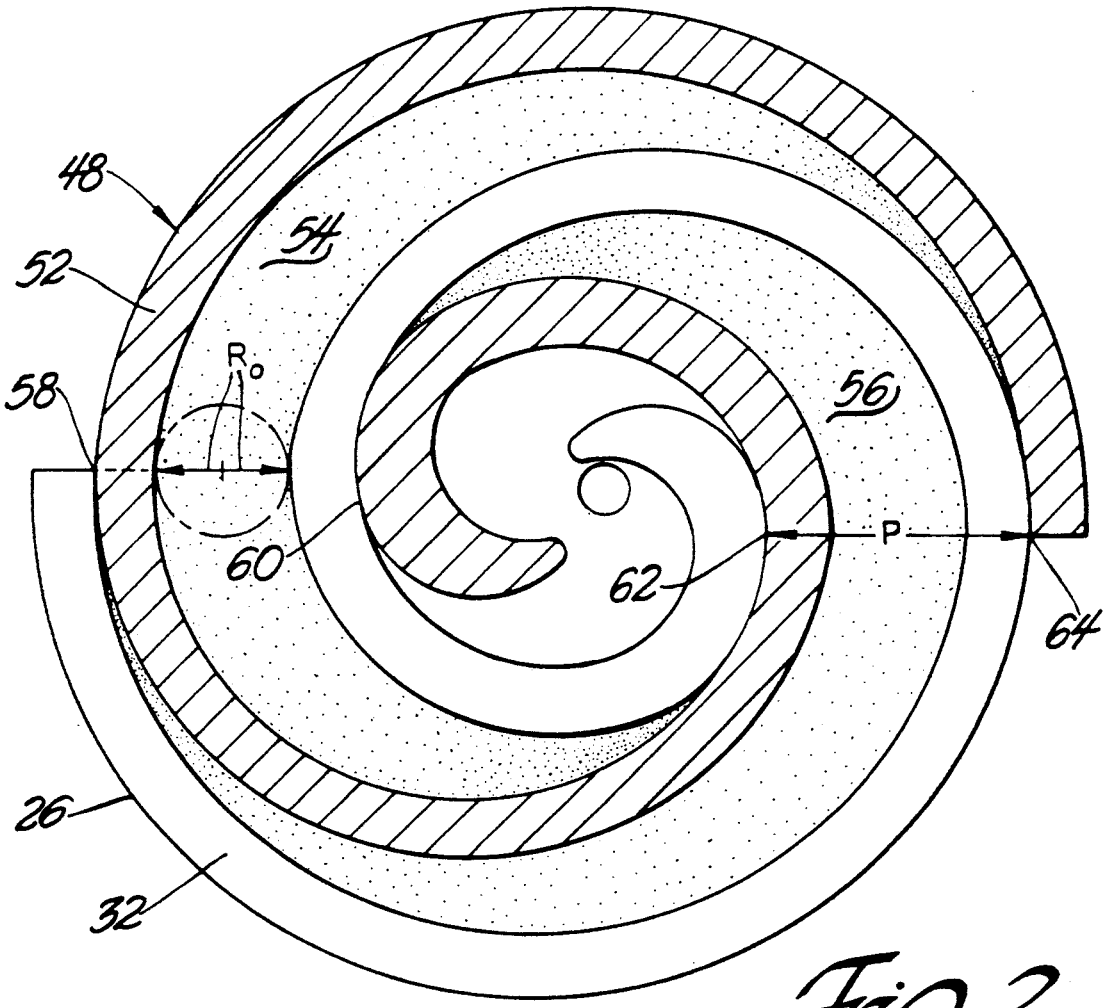
FIG. 2 is an enlarged diagrammatic sectional view of the fixed scroll and the wrap elements of the fixed and orbital scrolls taken at 2—2 in FIG. 1.

An orbital scroll 48 with an end plate 50 and an involute spiral wrap 52 cooperates with the fixed scroll 26 to form at least one pair of sealed fluid pockets 54 and 56 as shown in FIG. 2. The fluid pockets 54 and 56 are bound by wrap surface contact lines 58, 60, 62 and 64, by the end plates 30 and 50 and by the axial ends 66 and 68 of the wraps 32 and 52. Seals 70 are provided in grooves 72 in the axial ends 66 and 68 of the wraps 32 and 52 to prevent compressed fluid in the pockets 54 and 56 from passing between the axial ends 66 and 68 of the wraps 32 and 52 and the scroll end plates 30 and 50. The seals 70 accommodate expansion and contraction of the wraps 32 and 52 due to temperature changes during operation of the compressor 10.

The involute spiral wraps 32 and 52 have a common pitch P so that the wrap surfaces maintain contact lines 58, 60, 62 and 64 during orbital movement of the orbital scroll 48. When the orbital scroll 48 moves counter clockwise relative to the fixed scroll 26, as shown in FIG. 2, the contact lines 58, 60, 62 and 64 move counter clockwise along the surface of the wraps 32 and 52 and the sealed fluid pockets 54 and 56 decrease in volume. The fluid in the pockets is compressed due to the volume change and is moved toward the center of the scrolls and to the discharge aperture 34. The orbital scroll 48 follows a generally circular orbit with a radius $R_0$. The radius $R_0$, when the orbital scroll has a wrap the thickness $t_1$, and the fixed scroll has a wrap thickness $t_2$ is;

$$R_0=\tfrac{1}{2}(P-t_1-t_2)$$

The orbital scroll 48 is driven in an orbital path by a drive assembly 74. The drive assembly 74 includes a crankshaft 76 and an eccentric bushing 78. The crankshaft 76 includes a shaft portion 80, an integral co-axial flange 82 and a crank pin 84. The crankshaft 76 is rotatably supported in the front section 14 of the housing 12 by bearings 86 and 88. The crank pin 84 is rotatably journaled in a bore in the eccentric bushing 78. The eccentric bushing 78 is journaled in a boss 90 of the forward wall of the orbital scroll end plate 50 by a needle bearing 92.

A drive pulley 94 is rotatably supported by a ball bearing 96 on the front section 14 of the compressor housing 12. The crankshaft 76 is rotated by the drive pulley 94 when the electric coils 98 are energized and magnetic force pulls the disk 100 on the shaft 80 into contact with the disk 102 which is integral with the drive pulley 94.

A balance weight 104 is attached to the eccentric bushing 78 to balance the orbital movement of the orbital scroll 48. The balance weight 104 can also balance the crankshaft 76. However, the crankshaft 76, as shown, is balanced by a separate balance weight 106 attached to the crankshaft flange 82.

An axial thrust and anti-rotation assembly 108 is provided to prevent the scrolls 26 and 48 from separating axially due to the force of compressed fluid in the pockets 54 and 56 on the end plates 30 and 50. The assembly 108 also prevents rotation of the orbital scroll 48. It is necessary to prevent axial separation of the scrolls 26 and 48 to maintain sealing between the axial ends 66 and 68 of the wraps 32 and 52 and the end plates 30 and 50. The orbital scroll 48 is to be limited to a generally circular orbit and not allowed to rotate to maintain the line contacts 58, 60 62 and 64 between the surfaces of the wraps.

Figure 5:
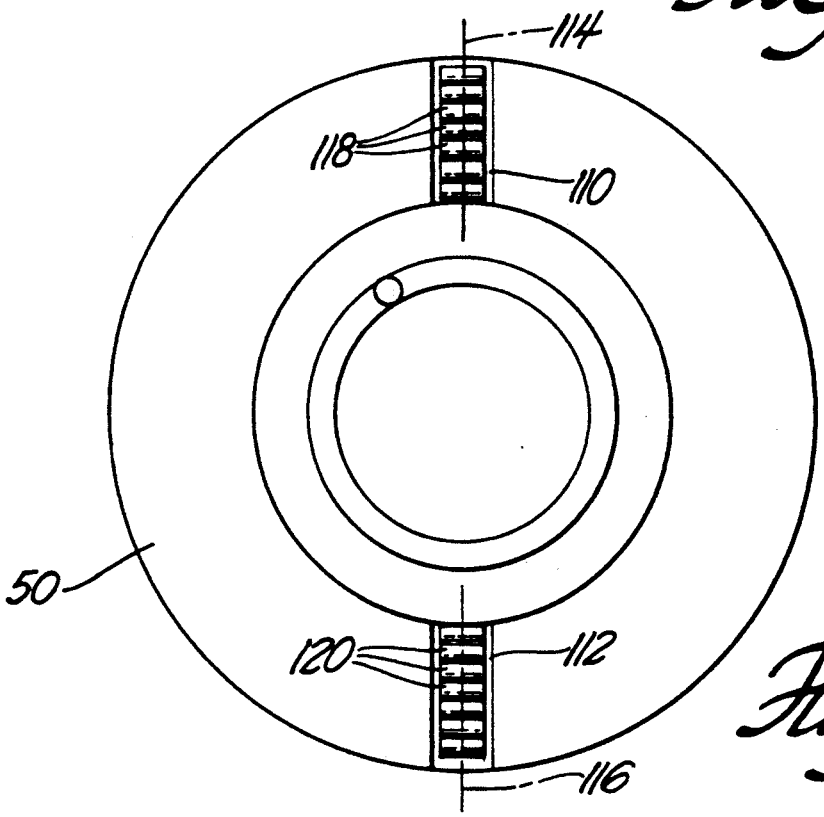
FIG. 5 is a sectional view taken at 5—5 in FIG. 1 showing a front view of the orbital scroll.

The axial thrust and anti-rotation assembly 108 includes a pair of scroll key ways 110 and 112 in the front side of the end plate 50 of the orbital scroll 48, as shown in FIG. 5. The key ways 110 and 112 have center lines 114 and 116 which are parallel. Roller bearing 118 and 120 are mounted in the bottom of the scroll key ways 110 and 112. Other anti-friction members could be used in place of the roller bearings if desired. Any members used should, however, be relatively thin in an axial direction to hold the overall length of the compressor to a minimum. A pair of housing key ways 122 and 124 are provided in the rearwardly facing wall 126 in the front section 14 of the housing 12. The housing key ways 122 and 124 have parallel center lines 128 and 130.

Figure 3:
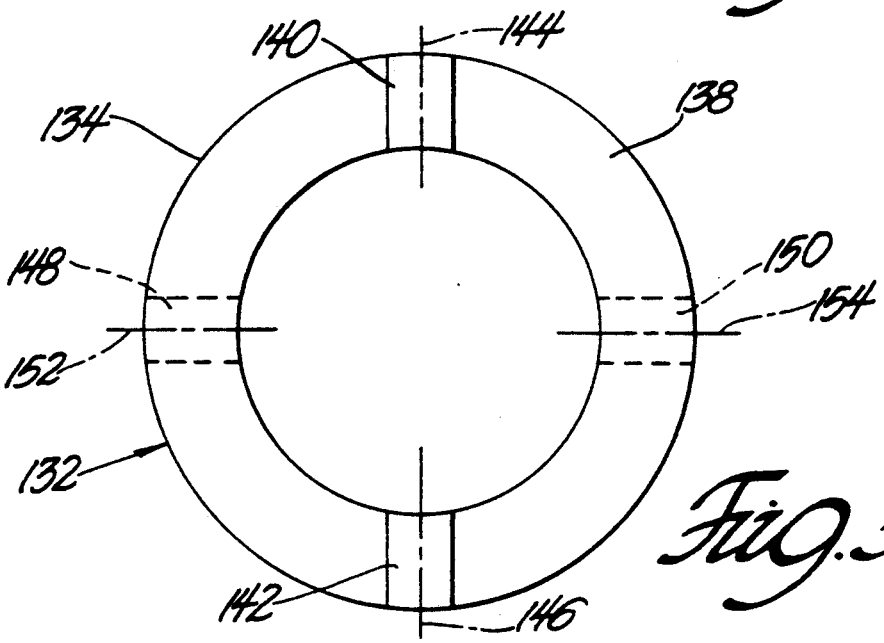
FIG. 3 is a reduced sectional view taken at 3—3 in FIG. 1 showing the Oldham coupler as viewed from the rear of the compressor.

An Oldham coupler 132 is provided to prevent rotation of the orbital scroll 48. The Oldham coupler 132 includes a relatively thin ring 134 with a front surface 136 and a rear surface 138. A pair of key blocks 140 and 142 are secured to the rear surface 138 of the ring 134. The key blocks 140 and 142 have center lines 144 and 146 that are parallel. A second pair of key blocks 148 and 150 are secured to the front surface 136 of the ring 134. The second pair of key blocks 148 and 150 have center lines 152 and 154 that are parallel. The center lines 144 and 146 are perpendicular to the center lines 152 and 154, as shown in FIG. 3. It is preferable that these center lines be perpendicular, but not mandatory. They can be at an angle other than perpendicular as long as the orbital scroll is permitted to move in a generally circular orbit and rotation of the orbital scroll is prohibited.

The Oldham coupler 132 is mounted in the housing 12 with key block 140 positioned in the scroll key way 110 and the key block 142 positioned in the scroll key way 112. The key blocks 140 and 142 are in contact with the roller bearings 118 and 120. The second pair of key blocks 148 and 150 on the front surface 136 of the ring 134 are positioned in the housing key way 122 and 124.

A pair of thrust roller assemblies 156 and 158 are mounted on the rearward facing wall 126 of the front section 14 of the housing 12. The thrust rollers 157 of the thrust roller assemblies 156 and 158 have axis of rotation that are perpendicular to the center lines 128 and 130 of the housing key ways 122 and 124 in the front section 14 of the housing 12. The thrust roller assemblies 156 and 158 are located on the rearward facing wall 126 in a position where they can contact the front surface 136 of the ring 134 directly in front of the key blocks 140 and 142 on the rear surface 138 of the ring 134.

In operation, the axial load applied to the end plate 50 of the orbital scroll 48, by the pressure of compressed fluid in the sealed pockets 54 and 56, is transferred from the end plate 50 to roller bearings 118 and 120 to the key blocks 140 and 142, to the ring 134, to the thrust roller assemblies 156 and 158 and to the front section 14 of the housing 12. Because the thrust roller assemblies 156 and 158 are directly across from roller bearings 118 and 120 in an axial direction, bending and twisting loads on the ring 134 are minimal. The minimal bending and twisting loads allow the use of a relatively thin ring 134 and shortens the overall length of the compressor. The thin ring 134 is relatively light weight. It is important to have a light weight Oldham coupler ring 134 to reduce vibration in the compressor 10. The Oldham coupler 132 reciprocates back and forth in a straight line, relative to the housing 12, making balancing difficult.

Figure 6:
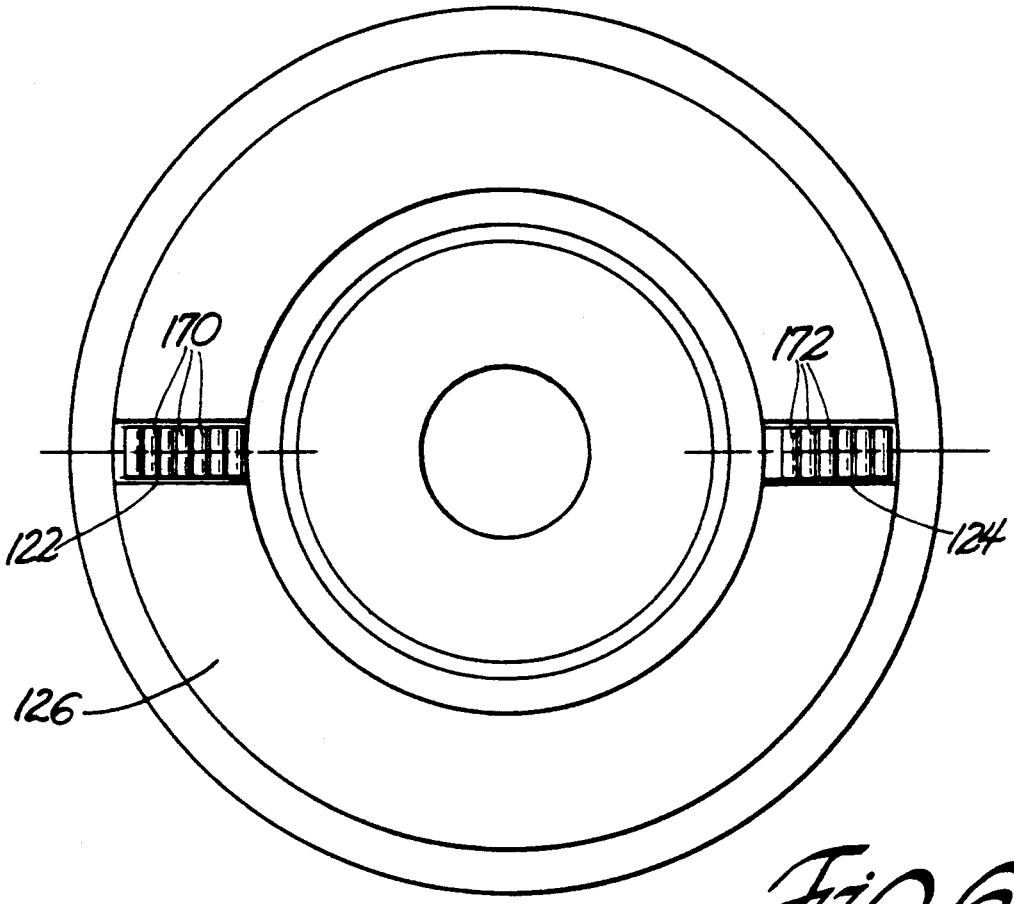
FIG. 6 is a sectional view of the front housing section similar to FIG. 4 for an alternative from of the compressor.
Figure 7:
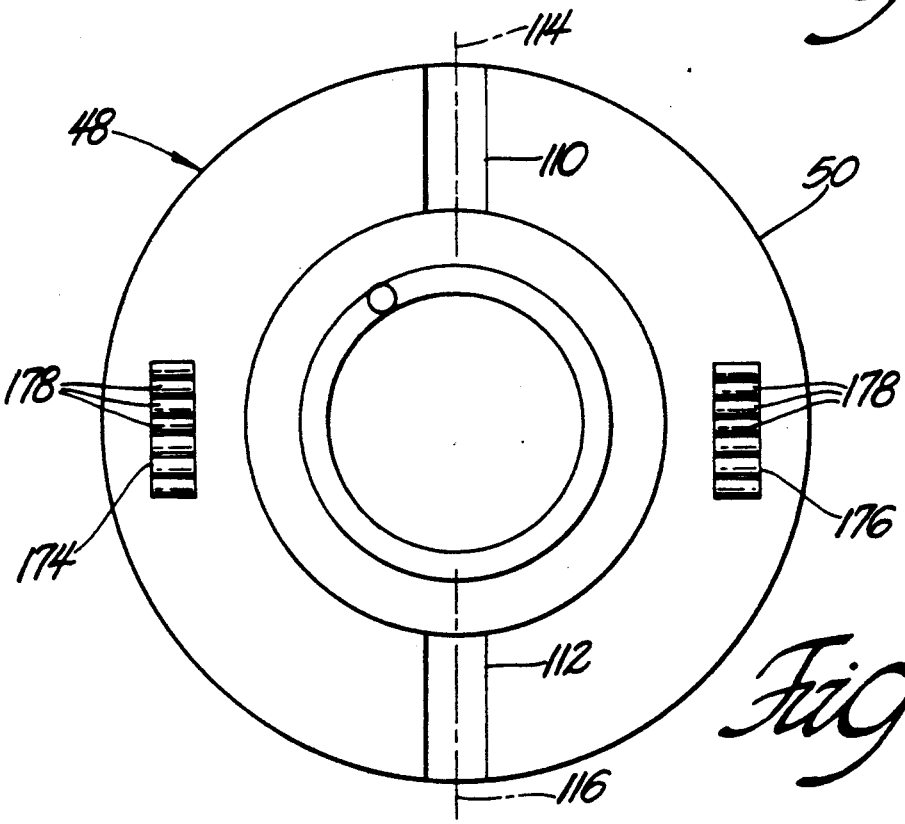
FIG. 7 is a sectional view of the orbital scroll similar to FIG. 5 for an alternative form of the compressor.

The axial load, applied by the pressure of compressed fluid in the sealed pockets 54 and 56 to the end plate 50 of the orbital scroll 40, is transferred to the compressor housing 12 in two locations, as described above. Two alternate locations for transferring axial load to the housing 12 could be used by placing roller bearings 170 and 172 in housing key ways 122 and 124 as shown in FIG. 6, and by placing thrust roller 174 and 176 on the end plate 50 for the orbital scroll 48, as shown in FIG. 7. The thrust roller 174 and 176 are located in a position where they can contact the rear surface 138 of the ring 134 directly to the rear of the key blocks 148 and 150 on the front surface 136 of the ring 134. The axis of rotation of rollers 178 in the thrust roller 174 and 176 is perpendicular to the center lines 114 and 116 of the scroll key way 110 and 112.

The roller bearings 170 and 172 and the thrust roller assemblies 174 and 176 can be employed together with the roller bearings 118 and 120 and the thrust roller assemblies 156 and 158. When the four roller bearings 118, 120, 170 and 172 and the four thrust roller assemblies 156, 158, 174 and 176 are used together, the axial load on the end plate 50 of the orbital scroll 48 is transferred to the compressor housing 12 in four locations.

Figure 4:
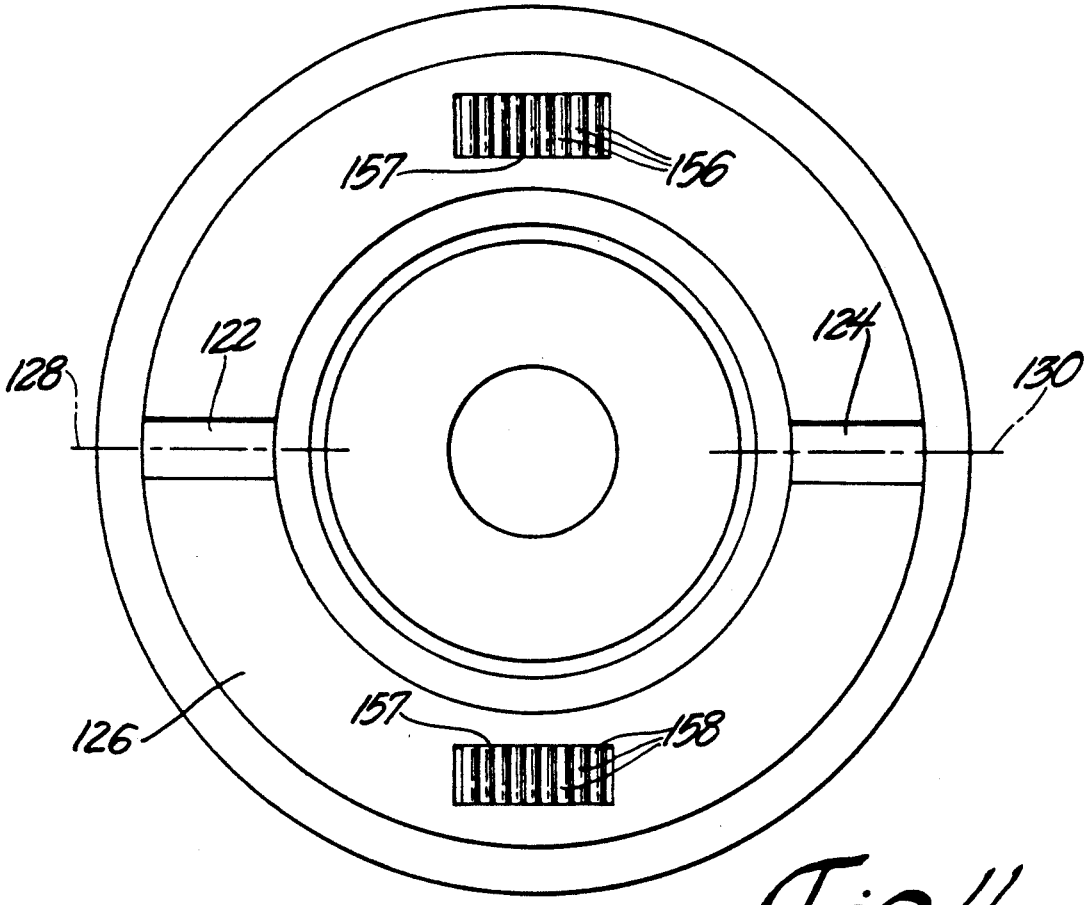
FIG. 4 is a sectional view taken at 4—4 in FIG. 1 showing a rear view of the front housing section.

The roller bearings 118 and 120 and the thrust roller assemblies 156 and 158 can be removed if the roller bearings 170 and 172 and the thrust roller assemblies 174 and 176 can transmit the entire axial load on the end plate 50 of the orbital scroll 48 and if only two locations are required to transmit the axial load to the housing 12 of the compressor. When the axial load is to be transmitted to the front section 14 of the housing 12 in two locations, two roller bearings and two thrust roller assemblies can be positioned as shown in FIGS. 1, 4 and 5 or alternatives as shown in FIGS. 6 and 7.

The scroll compressor, as described above, has a minimal number of surfaces that require high tolerance machining. This reduces cost and improves reliability of the compressors.

This invention has been described in detail in connection with a preferred embodiment of the invention. It will be easily understood by those skilled in the art that variations and modifications, some of which are suggested above, can be easily made without departing from the scope of the invention.

We claim:

1. A scroll type fluid compressor having a housing with a front section and a rear section; a fluid inlet in the housing; a fluid outlet in the housing; a fixed scroll with an end plate, a spiral wrap and a central discharge aperture through the end plate, mounted in the rear section of the housing; an orbital scroll with an end plate and a spiral wrap cooperating with the fixed scroll to form fluid pockets; an orbital scroll drive including a crankshaft rotatably journaled in the front section of the housing, connected to the orbital scroll and operable to move the orbital scroll in an orbital path; and an axial thrust and anti-rotation assembly, including scroll key ways in a front surface of the orbital scroll end plate having scroll key way center lines that are parallel to each other, housing key ways in the front section of the housing having housing key way center lines that are parallel to each other and angled with respect to the scroll key way center lines, a roller bearing mounted in the bottom of each housing key way, an Oldham coupler including a ring with a front surface and a rear surface, a first pair of key members extending from the rear surface of the ring and positioned in the scroll key ways, a second pair of key members extending from the front surface of the ring and positioned in the housing key ways and thrust rollers mounted between the orbital scroll and the Oldham coupler ring and contacting the rear surface of the Oldham coupler ring adjacent to the second pair of key members extending from the front surface of the ring, and in axial alignment with the second pair of key members.

2. A scroll type fluid compressor having a housing with a front section and a rear section; a fluid inlet in the housing; a fluid outlet in the housing; a fixed scroll with an end plate a spiral wrap and a control discharge aperture through the end plate, mounted in the rear section of the housing; an orbital scroll with an end plate and a spiral wrap cooperating with the fixed scroll to form fluid pockets; drive including a crankshaft rotatably journaled in the front section of the housing, connected to the orbital scroll and operable to move the orbital scroll in an orbital path; and an axial thrust and anti-rotational assembly including, a pair of scroll key ways in a front surface of the orbital scroll end plate having scroll key way center lines that are parallel to each other, a pair of housing key ways in the front section of the housing having housing key way center lines that are parallel to each other and angled with respect to the center lines of the scroll key ways, a roller bearing mounted in the bottom of each orbital scroll key way and having a plurality of rollers with axes of rotation that are perpendicular to the scroll key way center lines, an Oldham coupler including a ring with a front surface and a rear surface, a first pair of key members extending from the rear surface of the ring and positioned in the scroll key ways in an axial position that is determined by the roller bearing in each orbital scroll key way, a second pair of key members extending from the front surface of the ring and portioned in the housing key way and a pair of thrust roller assemblies mounted in the front section of the housing and each contacting the front surface of the Oldham coupler ring adjacent to and in axial alignment with the first pair of key members extending from the rear surface of the ring and wherein each thrust roller assembly has rollers with axes of rotation that are perpendicular to housing key way center lines.

3. A scroll type fluid compressor having a housing with a front section and a rear section; a fluid inlet in the housing; a fluid outlet in the housing; a fixed scroll with an end plate, a spiral wrap and a central discharge aperture through the end plate, mounted in the rear section of the housing; an orbital scroll with an end plate and a spiral wrap cooperating with the fixed scroll to form fluid pockets; an orbital scroll drive including a crankshaft rotatably journaled in the front section of the housing, connected to the orbital scroll and operable to move the orbital scroll in an orbital path; and a axial thrust and anti-rotation assembly, including a pair of scroll key ways in a front surface of the orbital scroll end plate, having scroll key way center lines that are parallel, a pair of housing key ways in the front section of the housing, having housing key way center lines that are parallel to each other and angled with respect to the scroll key way center lines, a roller bearing mounted in the bottom of each of the four key ways, an Oldham coupler, including a ring with a front surface and a rear surface, a first pair of key members extending from the rear surface of the ring and positioned in the scroll key ways, a second pair of key members extending from the front surface of the ring and positioned in the housing key ways, a pair of thrust roller assemblies each contacting the front side of the Oldham coupler ring and the housing adjacent to and in axial alignment with one of the key members of the first pair of key members extending from the rear surface of the ring and wherein each thrust roller assembly has a plurality of rollers with axes of rotation that are perpendicular to housing key way center lines, and a pair of thrust roller assemblies each contacting the rear side of the Oldham Coupler ring and the orbital scroll adjacent to and in axial alignment with one of the key members of the second pair of key members extending from the front surface of the ring and wherein each thrust roller assembly has a plurality of rollers with axes of rotation that are perpendicular to the orbital scroll key way center lines.

* * * * *